US010962316B2

(12) United States Patent
Young et al.

(10) Patent No.: US 10,962,316 B2
(45) **Date of Patent: *Mar. 30, 2021**

(54) FIREARM WITH PRESSURE RELIEVING FEATURES

(71) Applicant: Desert Leasing & Licensing LLC, West Valley City, UT (US)

(72) Inventors: Nicholas E. Young, Murray, UT (US); Jason Pittman, Sunrise, FL (US)

( * ) Notice: Subject to any disclaimer, the term of this patent is extended or adjusted under 35 U.S.C. 154(b) by 70 days.

This patent is subject to a terminal disclaimer.

(21) Appl. No.: 16/559,627

(22) Filed: Sep. 4, 2019

(65) Prior Publication Data

US 2020/0080808 A1 Mar. 12, 2020

Related U.S. Application Data

(62) Division of application No. 15/860,837, filed on Jan. 3, 2018, now Pat. No. 10,443,965.

(51) Int. Cl.

| | |
|---|---|
| ***F41A 21/48*** | (2006.01) |
| ***F41A 13/06*** | (2006.01) |
| ***F41A 21/28*** | (2006.01) |
| *F41C 7/00* | (2006.01) |
| *F41A 9/38* | (2006.01) |

(52) U.S. Cl.

CPC ..... *F41A 13/06* (2013.01); *F41A 21/28* (2013.01); *F41A 9/38* (2013.01); *F41C 7/00* (2013.01)

(58) Field of Classification Search

CPC ..... F41A 21/485; F41A 15/16; F41A 23/06; F41A 23/10; F41A 23/14

USPC ..... 42/75.01–76.1, 94

See application file for complete search history.

(56) References Cited

U.S. PATENT DOCUMENTS

| | | | | |
|---|---|---|---|---|
| 4,685,235 | A * | 8/1987 | Bunning | F41A 21/484 42/75.02 |
| 5,907,919 | A * | 6/1999 | Keeney | F41A 21/485 42/75.02 |
| 5,983,773 | A * | 11/1999 | Dionne | F41A 3/86 42/77 |
| 6,276,252 | B1 * | 8/2001 | Dionne | F41A 3/86 42/77 |
| 8,132,348 | B1 * | 3/2012 | Post | F42B 33/14 42/51 |
| 9,347,719 | B1 * | 5/2016 | Stone | F41C 23/18 |
| 10,107,582 | B2 * | 10/2018 | Gray | F41A 21/482 |
| 2011/0173867 | A1 * | 7/2011 | Young | F41C 23/14 42/94 |

(Continued)

*Primary Examiner* — Michael D David

(57) ABSTRACT

Firearms and barrel assemblies are provided herein that include a barrel assembly having a barrel having a proximal end and a distal end comprising a muzzle. The barrel also includes a chamber defined in the proximal end. The chamber includes a distal end and a proximal end. A bore extends distally from the distal end of the chamber. The bore defines a central axis of the barrel assembly. The barrel assembly also includes a barrel extension extending from the proximal end of the barrel. The barrel extension has a distal end and a proximal end. The barrel extension defines a bolt receiving recess in communication with the chamber. The barrel extension further has a barrel vent channel defined therein in communication with the bolt receiving recess. The barrel vent channel is defined in the barrel extension in a direction that is transverse to the central axis of the barrel assembly.

8 Claims, 7 Drawing Sheets

(56) References Cited

U.S. PATENT DOCUMENTS

| | | | | |
|---|---|---|---|---|
| 2012/0073179 | A1* | 3/2012 | Young | F41A 21/485<br>42/75.02 |
| 2015/0040451 | A1* | 2/2015 | Young | F41A 15/16<br>42/25 |
| 2016/0348990 | A1* | 12/2016 | Steil | F41G 1/033 |

* cited by examiner

FIREARM WITH PRESSURE RELIEVING FEATURES

CROSS-REFERENCE TO RELATED APPLICATIONS

This application is a divisional application of U.S. Non-Provisional application Ser. No. 15/860,837 filed Jan. 3, 2018, the disclosure of which is hereby incorporated by reference in its entirety.

BACKGROUND

Bullpup or other short-configuration rifles are designed to have a short, overall length compared to conventionally configured rifles, yet they maintain a relatively longer barrel. Such configurations place the action closer to the operator compared to conventionally configured rifles. Firing cartridges from firearms involves high pressure gases being generated in the action, which are used to drive a projectile from the action through and out of the muzzle of the barrel. If the barrel becomes obstructed and a round is discharged in the chamber, the pressure rearward of the barrel may become excessive and cause undesirable consequences, such as allowing the gas and/or components destroyed or damaged by the gas to be directed toward an operator.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

A barrel assembly is provided herein. The barrel assembly includes a barrel having a distal end and a proximal end. A chamber is defined in the proximal end. The chamber includes a distal end and a proximal end. A bore extends distally from the distal end of the chamber. The bore defines a central axis of the barrel assembly. The barrel assembly also includes a barrel extension extending from the proximal end of the barrel. The barrel extension has a distal end and a proximal end. The barrel extension defines a bolt receiving recess in communication with the chamber. The barrel extension further has a barrel vent channel defined therein in communication with the bolt receiving recess. The barrel vent channel is defined in the barrel extension in a direction that is transverse to the central axis of the barrel assembly. In at least one example, the barrel extension further comprises barrel lugs in the proximal end, in which the barrel vent channel is defined in the barrel extension at a position that is distal of the barrel lugs. In at least one example, the barrel vent channel is defined in the barrel extension at a position that is near the proximal end of the chamber. In at least one example, the barrel and the barrel extension are a single piece. In at least one example, the barrel assembly further includes a gas block coupled to the barrel.

According to one example, the firearm also includes a bolt assembly that includes a bolt having a distal end and a proximal end. The distal end of the bolt has a bolt face formed thereon and a sealing ring between the bolt face and the proximal end of the bolt. According to one example the distal end of the bolt is configured to be at least partially received within the barrel extension to move the bolt assembly into battery. While the bolt assembly is in battery, the sealing ring at least partially obstructs a gap between the bolt and the barrel extension when the bolt assembly is in battery.

According to one example the bolt further includes a plurality of bolt lugs and the barrel extension includes a plurality of barrel lugs, the bolt lugs being configured to be received within the barrel extension distally of the barrel lugs when the bolt assembly is in battery. According to one example the sealing ring abuts the barrel lugs when the bolt assembly is in battery. According to one example the barrel lugs includes extraction support lugs and case support lugs, the extraction support lugs extending distally more than the case support lugs. According to one example the firearm is configured as auto-loading rifle. According to one example the barrel vent channel is defined in the barrel extension at a position that is at least partially between the proximal end of the chamber and the bolt face when the bolt assembly is in battery. According to one example the barrel vent channel is defined in the barrel extension at a position that is entirely between the proximal end of the chamber and the bolt face when the bolt assembly is in battery.

According to another example, the firearm also includes a receiver assembly includes a barrel coupling portion configured to have the barrel assembly coupled thereto. The barrel coupling portion has at least one vent opening defined therein in communication with the barrel vent channel when the barrel is coupled to the receiver. According to one example, the barrel coupling portion of the receiver assembly includes a barrel block configured to have the barrel assembly coupled thereto in which the vent opening is a barrel block vent defined in the barrel block. The barrel block vent is in communication with the barrel vent opening when the barrel assembly is coupled to the receiver. According to one example, the receiver has a central opening defined therein and the barrel block vent opening is in communication with the central opening when the barrel assembly is coupled to the receiver assembly. According to one example, the receiver has at least one receiver vent opening in further communication with the central opening of the receiver. According to one example, the receiver includes an upper portion and a lower portion defining the central opening of the receiver, wherein the receiver vent opening is defined in the upper portion of the receiver and the barrel block is coupled to the lower portion of the receiver. According to one example, the firearm further includes at least one plug removably inserted into the receiver vent opening. According to one example, the firearm is configured as an auto-loading rifle.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Barrel assemblies, actions, receivers, and rifles are provided herein that are configured to contain and direct gasses generated during overpressure firing to flow transversely to the axial direction of the barrel to guide the gasses along predetermined, alternate flow paths to help reduce the flow of gasses toward an operator. Overpressure firing conditions typically occur when a cartridge is fired while the barrel is obstructed and particularly while the barrel is obstructed near the chamber. The axial translations or movement set forth herein will be understood to be generally parallel to an axis defined by a center of the barrel. Lateral or transverse movement may be described with respect to any datum. The axis is generally coincident with a bore (best seen in defined in the barrel which extends from a chamber defined in the rearward end of the barrel and extending through the muzzle.

Figure 1A:
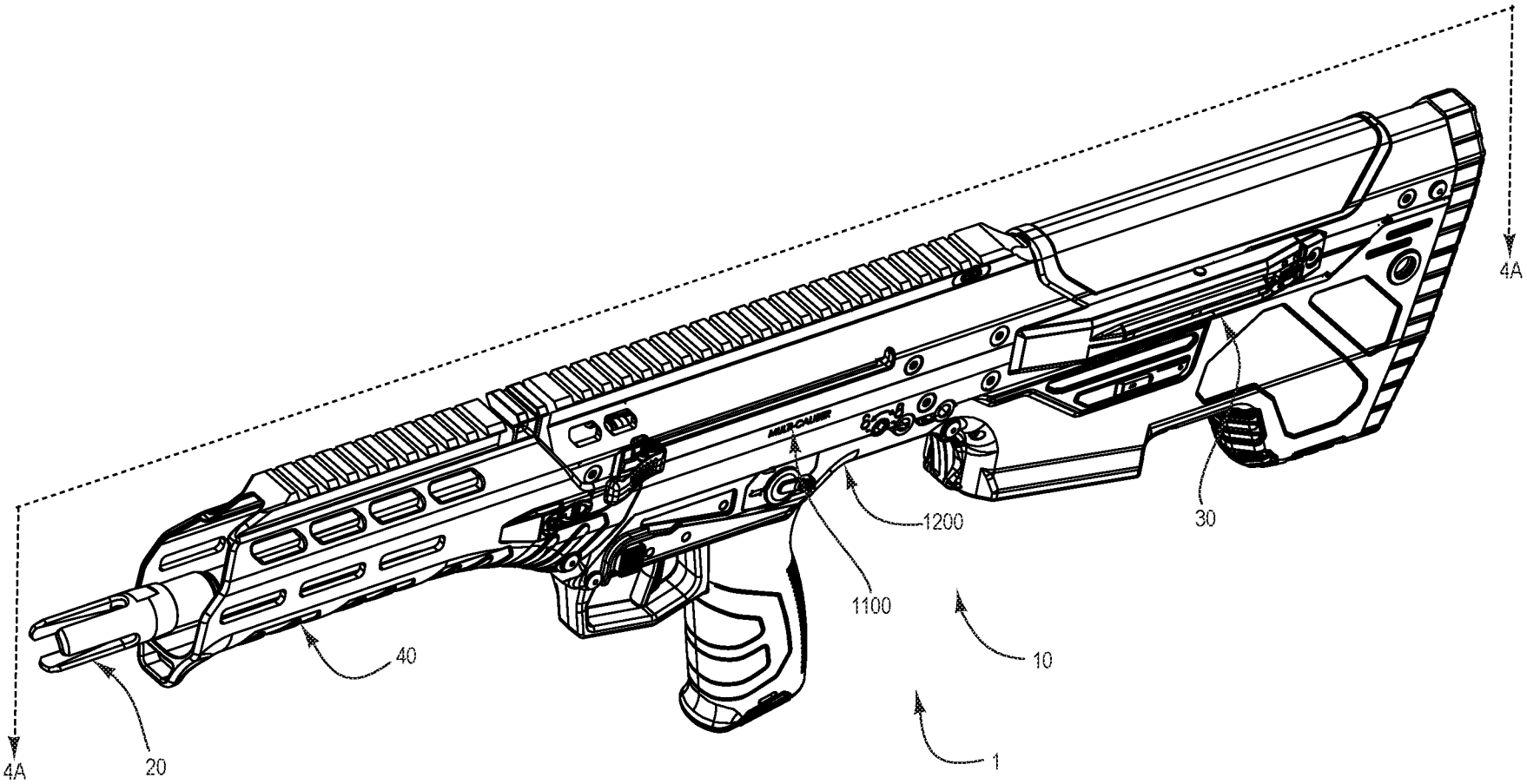
FIG. 1A illustrates a perspective view a firearm according to one example.
Figure 3:
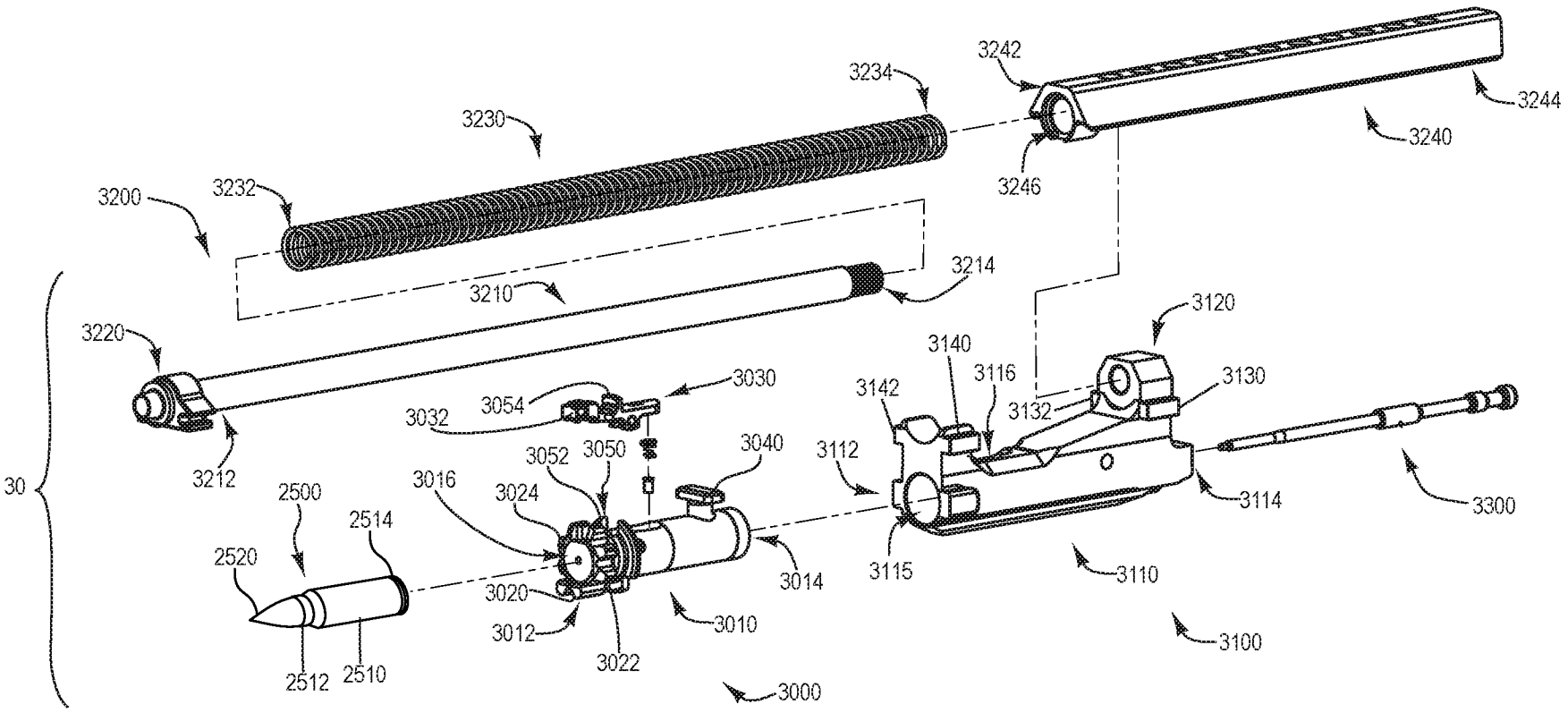
FIG. 3 is an exploded view of an action according to one example.

FIG. 1A is a perspective view of a firearm 1. As illustrated in FIG. 1A, the firearm 1 may be configured as an autoloading rifle, which includes semi-automatic and automatic rifles, though it will be appreciated that the firearm 1 may have other configurations, such as bolt action and other types of actions, which may include pistols, revolvers, and other types of firearms. The firearm 1 includes a receiver assembly 10. The receiver assembly 10 includes an upper receiver assembly 1100 and a lower receiver assembly 1200. In the illustrated example, the upper receiver assembly 1100 is configured to couple or facilitate coupling of a barrel assembly 20 to an action 30 (FIG. 3).

In at least one example, the firearm 1 further includes a stock assembly 40 coupled to the receiver assembly 10. It will be appreciated that the stock assembly 40 may be partially or completely integrated with the receiver assembly 10 in some examples. Further, the barrel assembly 20 is shown as being removably coupled to the upper receiver assembly 1100, though it will be appreciated that barrel assembly 20 may be integrated with any number of components of the receiver assembly 10 and the upper receiver assembly 1100 in particular.

The upper receiver assembly 1100 and lower receiver assembly 1200 are configured to cooperate to facilitate operation of the action 30 (FIG. 3) to cycle a cartridge (2500, FIG. 3) into a chamber (2140, FIG. 4B) defined in the barrel assembly 20 and bring a bolt assembly (3000, FIG. 3) into battery, allowing the action 30 (FIG. 3) to fire the cartridge. Firing the cartridge ignites gunpowder in the cartridge 2500 (FIG. 3) to generate rapidly expanding gasses. The rapidly expanding gasses propel a projectile 2520 (FIG. 3) from the barrel assembly 20. As will be discussed in more detail hereinafter, the configuration of the barrel assembly 20 and the upper receiver assembly 1100 allow the rifle 1 to with gasses during overpressure firing by directing the gasses in desired directions. The configuration of the upper receiver assembly 1100 will first be introduced, followed by a discussion of the barrel assembly 20 and its coupling to the upper receiver assembly 1100.

Figure 1B:
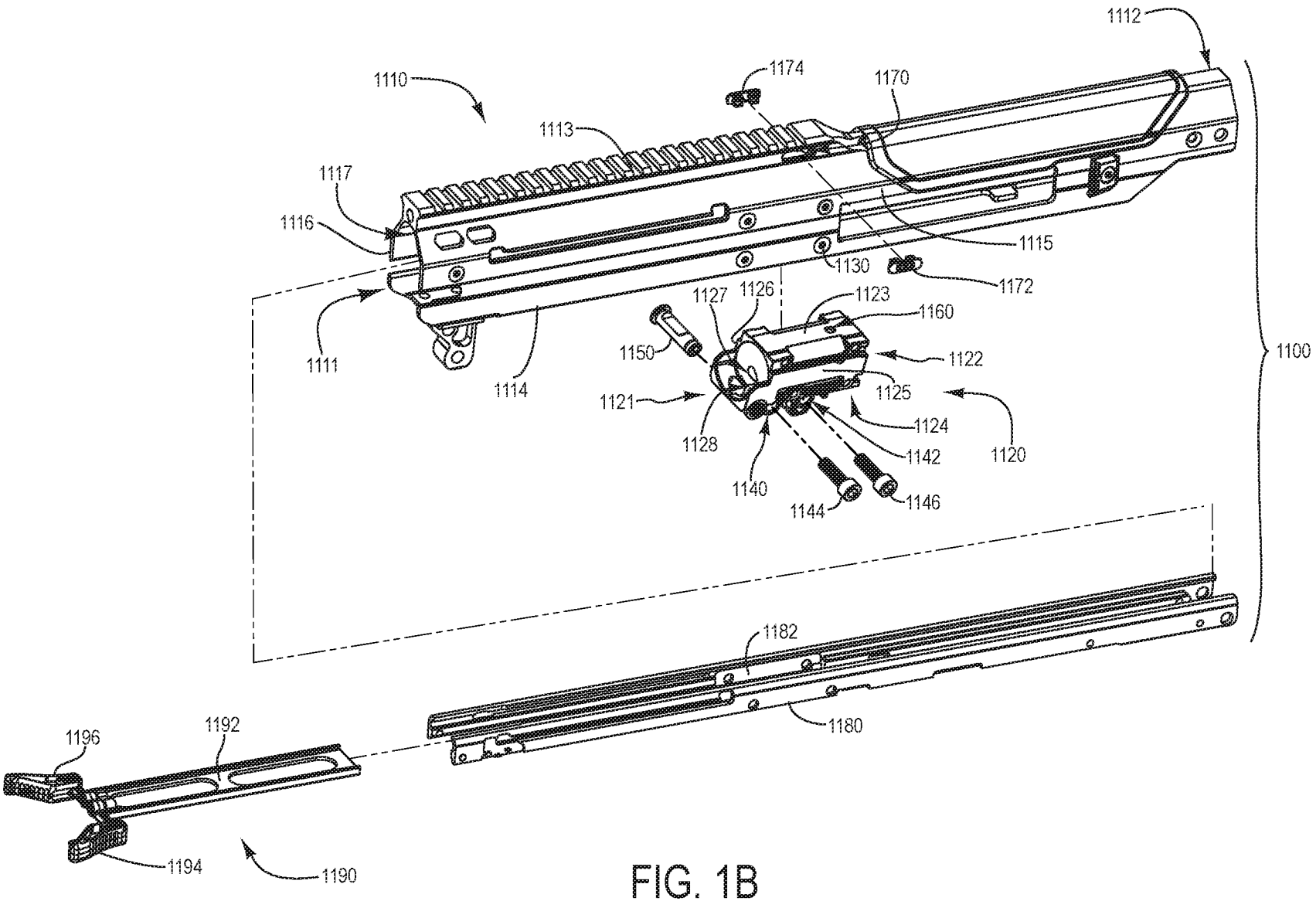
FIG. 1B is an exploded perspective view of an upper receiver assembly according to one example.

FIG. 1B is an exploded view of the upper receiver assembly 1100. The upper receiver assembly 1100 may include an upper receiver body 1110 having a front or distal portion 1111, a rear or proximal portion 1112, a top portion 1113, a bottom portion 1114, a first opposing sidewall portion 1115, and a second sidewall portion 1116 which cooperate to define a central opening 1117. The front portion 1111 may be configured to couple to and/or receive the barrel assembly 20 (FIG. 2A) such that a sufficient portion of the barrel assembly 20 (FIG. 2A) is fitted within the upper receiver assembly 1100 to allow the barrel assembly 20 to be secured thereto.

Referring still to FIG. 1B, a barrel coupling portion of the upper receiver assembly 1100, such as a barrel block 1120 may be used to secure the barrel assembly 20 (FIG. 2A) to the upper receiver assembly 1100. The barrel block 1120 generally includes a front portion 1121, a rear portion 1122, a top portion 1123, a bottom portion 1124, and opposing side portions 1125, 1126. The barrel block 1120 itself is configured to be secured to the upper receiver body 1110. Fasteners 1130 extend through the opposing sidewalls 1115, 1116 of the upper receiver body 1110 and into the side portions 1125, 1126 of the barrel block 1120. For example, the barrel block 1120 may be fitted into a corresponding recess (not shown) in the bottom portion 1124 of the upper receiver body 1110 and then secured in place with the fasteners 1130.

As shown in FIG. 1B, a barrel receiving opening 1127 is defined in the front portion 1121 of the barrel block 1120 and extends rearwardly therefrom. A barrel block vent opening 1160 is defined in a top portion of the 1123 of the barrel block 1120 and is in communication with the barrel receiving opening 1127. A slot 1128 is further defined in the bottom portion 1124 of the barrel block. 1120, the slot 1128 extending to be in communication with the barrel receiving opening 1127. The barrel receiving opening 1127 in the present example is configured to receive a portion of the barrel assembly 20 (FIG. 2A), and a barrel extension 2200 (FIG. 2A) in particular when the slot 1128 is in a default or open state, thereby allowing the barrel assembly 20 (FIG. 2A) to be received at least partially within the barrel block 1120.

In such a configuration, closing or narrowing the slot 1128 acts to tighten or reduce the size the of barrel receiving recess 1127 and expanding the slot 1128 acts to open the barrel receiving recess 1127. Accordingly, decreasing the size of the slot 1128 acts to tighten the barrel block 1120 onto the barrel assembly 20 (FIG. 2A), and the barrel extension 2200 (FIG. 2A) in particular, when the barrel extension 2200 (FIG. 2A) is in place relative to the barrel block 1120. As a result, when the barrel block 1120 is in place and secured to the upper receiver assembly 1100, expanding or contracting the slot 1128 acts to secure or release the barrel assembly 20 (FIG. 2A) with respect to the upper receiver assembly 1100. It will be appreciated that other configurations are possible that allow the barrel assembly 20 (FIG. 2A) to be selectively secured to and released from the upper receiver assembly 1100.

As shown in FIG. 1B, the barrel block 1120 includes holes 1140, 1142 in the bottom portion 1124 that are configured to receive and engage fasteners 1144, 1146. Tightening the fasteners 1144, 1146 acts to close the slot 1128 while loosening the fasteners 1144, 1146 allows the slot 1128 to expand. As a result, the fasteners 1144, 1146 may be tightened to secured the barrel assembly 20 to the upper receiver assembly 1100 via the barrel block 1120 or to release the barrel assembly 20 from the upper receiver assembly 1100. The barrel block 1120 further includes a locking bolt 1150 configured to engage a correspond opening 1127 in the barrel block 1120. Such a configuration may allow for rapidly switching or changing barrel assemblies while still providing the rifle 1 (FIG. 1A) with a pathway to vent gas during over-pressure firing. While one manner of coupling the barrel block 1120 to the upper receiver body 1110, in other examples the barrel block 1120 may be partially or completely integrally formed with the upper receiver body 1110 or coupled to the upper receiver body 1110 in other ways.

In the illustrated example, the upper receiver body 1110 also includes features configured to provide additional pathways to vent gas during over-pressure firing. In particular, a receiver vent channel 1170 is defined in the top portion 1113 of the upper receiver body 1110. As will be discussed in more detail hereinafter, the receiver vent channel 1170 is in communication with the central opening 1117, which in turn is in communication with the barrel block vent opening 1160, which cooperate the barrel vent channel 2400 (FIG. 2A) to provide a pathway out of the barrel assembly 20 (FIG. 2A) in the event of a barrel obstruction.

As shown in FIG. 1B, the upper receiver assembly 1100 may also include receiver vent plugs 1172, 1174 configured to be coupled to the plug the receiver vent channel 1170 to prevent debris from entering the upper receiver body 1110 during normal operation while allowing the receiver vent plugs 1172, 1174. As will be discussed in more detail at an appropriate point hereinafter, such a configuration may allow the receiver vent plugs 1172, 1174 to be blown out during over-pressure firing to provide an additional vent pathway. As illustrated in FIG. 1B, such a vent pathway may vent the gas from the upper receiver assembly 1100 in a direction that is transverse to the axis 2120 (FIG. 2A)

The upper receiver assembly 1100 is also configured to guide the action 30 (FIG. 3) as it loads, fires, and extracts cartridges 2500 (FIG. 2). Particularly, the upper receiver assembly 1100 includes rails 1180, 1182 configured to be secured to the interior of the opposing side portions 1115, 1116 of the upper receiver body 1110. The rails 1180, 1182 are configured to engage a charging assembly 1190. The charging assembly 1190 includes a charging block 1192 and charging handles 1194, 1196 coupled to the charging block 1192. Though described as part of the upper receiver assembly 1100, the charging assembly 1180 may also be described as part of the action 30 (FIG. 3). Further, it will be appreciated that the charging handles 1194, 1196 extend through the upper receiver body 1110 when the charging assembly 1190 is in position between the rails 1182, 1184 inside the upper receiver body 1110.

Figure 2A:
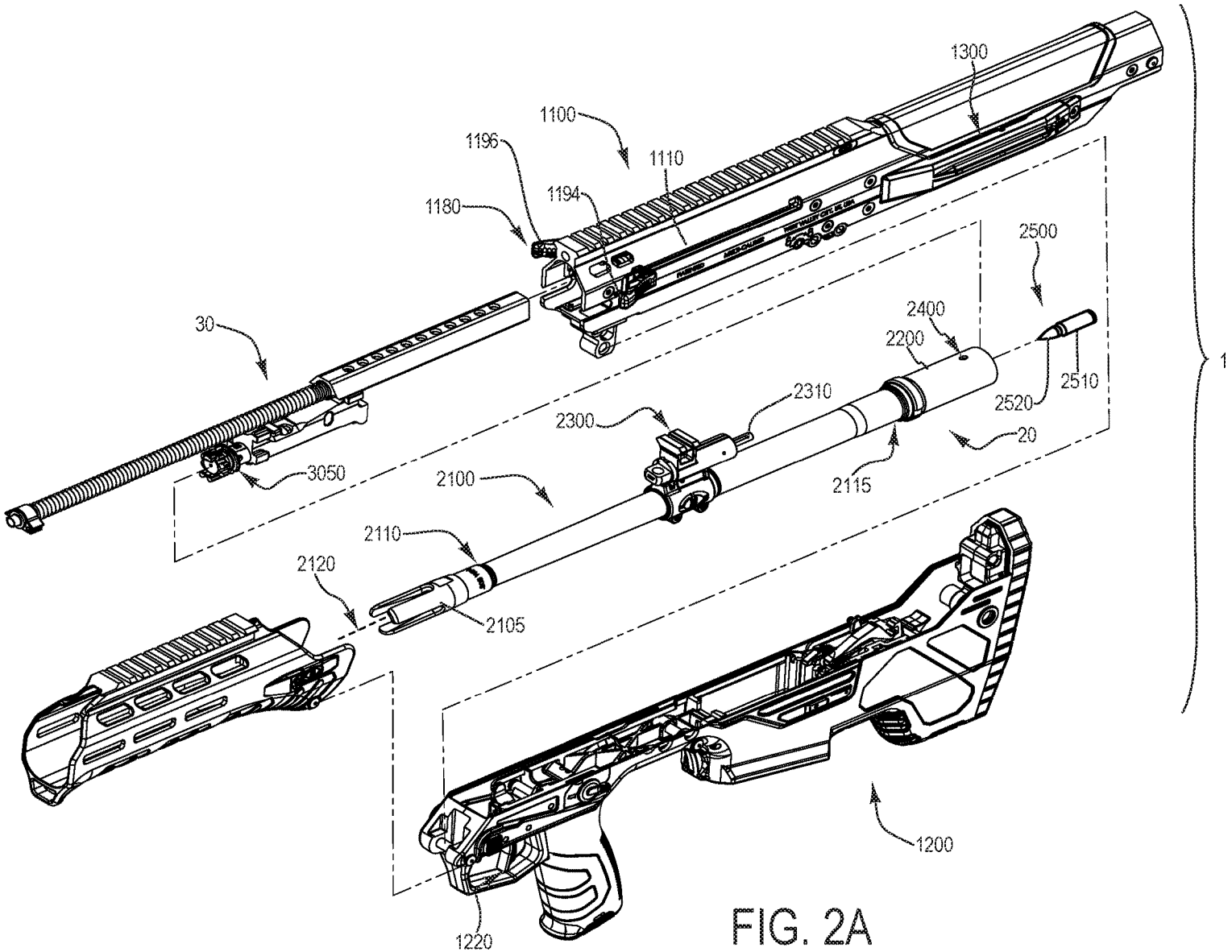
FIG. 2A is an exploded view of the firearm of FIG. 1A according to one example.

FIG. 2A is an exploded view of the rifle 1 in which the charging assembly 1190 is in place within the upper receiver assembly 1100 with the charging handles 1194, 1196 extending through the upper receiver body 1110. The upper receiver assembly 1100 is configured to couple to the lower receiver assembly 1200. The action 30 is also configured to be received within the upper receiver assembly 1100 so as to allow the barrel assembly 20 to be coupled to the upper receiver assembly 1100 and the action 30.

As shown in FIG. 2A, the barrel assembly 20 generally includes a barrel 2100, a flash suppressor 2105, and a barrel extension 2200. In at least one example, the barrel extension 2200 facilitates coupling of the barrel 2100 to the upper receiver assembly 1100. It will be appreciated the barrel extension 2200 may be integrally formed with the barrel 2100 in some examples.

The barrel 2100 includes muzzle 2110 or distal end. Relative position or movement toward the muzzle 2110 will be described as forward movement, and such position may be generally described as front or frontward. Similarly, components or parts of components which are more distal from the muzzle 2110 will be described as being rearward of other elements located more proximal to the muzzle 2110, and such position will be described as rear or proximal locations. The axial translations or movement set forth herein will be understood to be generally parallel to an axis 2120 defined by a center of the barrel 2100. Lateral or transverse movement may be described with respect to any datum. The axis 2120 is generally coincident with a bore 2130 (best seen in FIG. 4B) defined in the barrel 2100 which extends from a chamber 2140 (also best seen in FIG. 4B) defined in a proximal end 2115 of the barrel 2100 and extending through the muzzle 2110.

The action 30 feeds the cartridge 2500 into the barrel assembly 20. The cartridge includes a case 2510 containing and a projectile 2520. The case 2510 includes a neck 2512 and a rim 2514 (best seen in FIG. 3). A trigger assembly 1220 is coupled to or integrated with the lower receiver 1200. Once the cartridge 2500 has been fed into place in the barrel assembly 20, the trigger assembly 1220 may be operated to cause the action 30 to ignite a powder charge contained in the case 2510.

The burning powder charge generates hot, rapidly expanding gasses. During normal firing, the rapidly expanding gasses drive the projectile 2520 through the barrel assembly 20 and out the muzzle 2110 of the barrel 2100 while causing the portion of the case 2510 in the chamber 2140 (FIG. 4B) to expand to conform to the shape of the chamber 2140. The rim 2514 (FIG. 3) may be more resistant to deformation than the rest of the case 2510, which may help ensure the gas is directed distally and axially during normal firing while also allowing the rim 2514 (FIG. 3) to retain its shape to allow for extraction of the then spent case 2510.

In the illustrated example, the rifle 1 is configured as a semi-automatic or automatic rifle. Accordingly, the barrel assembly 20 also includes a gas block 2300. Further, the gas block 2300 includes a piston 2310 associated therewith, though it will be appreciated direct-impingement configurations are contemplated according to the present disclosure. In either example, some portion of gasses generated by firing the cartridge 2500 are directed from the barrel 2100 to the gas block 2300. The gasses act on the piston 2310 to cause the piston 2310 to interact with the action 30 to provide the energy for the action 30 to extract the (then spent) case 2510.

An ejection assembly 1300 is shown coupled to the upper receiver assembly 1100. The ejection assembly 1300 cooperates with the action 30 to eject the spent case 2510. Ejection assemblies are described in more detail in U.S. Pat. No. 9,109,849, the disclosure of which is hereby incorporated by reference. Once a spent case 2510 has been ejected, a new cartridge is fed into place for firing according to the same process.

Figure 4A:
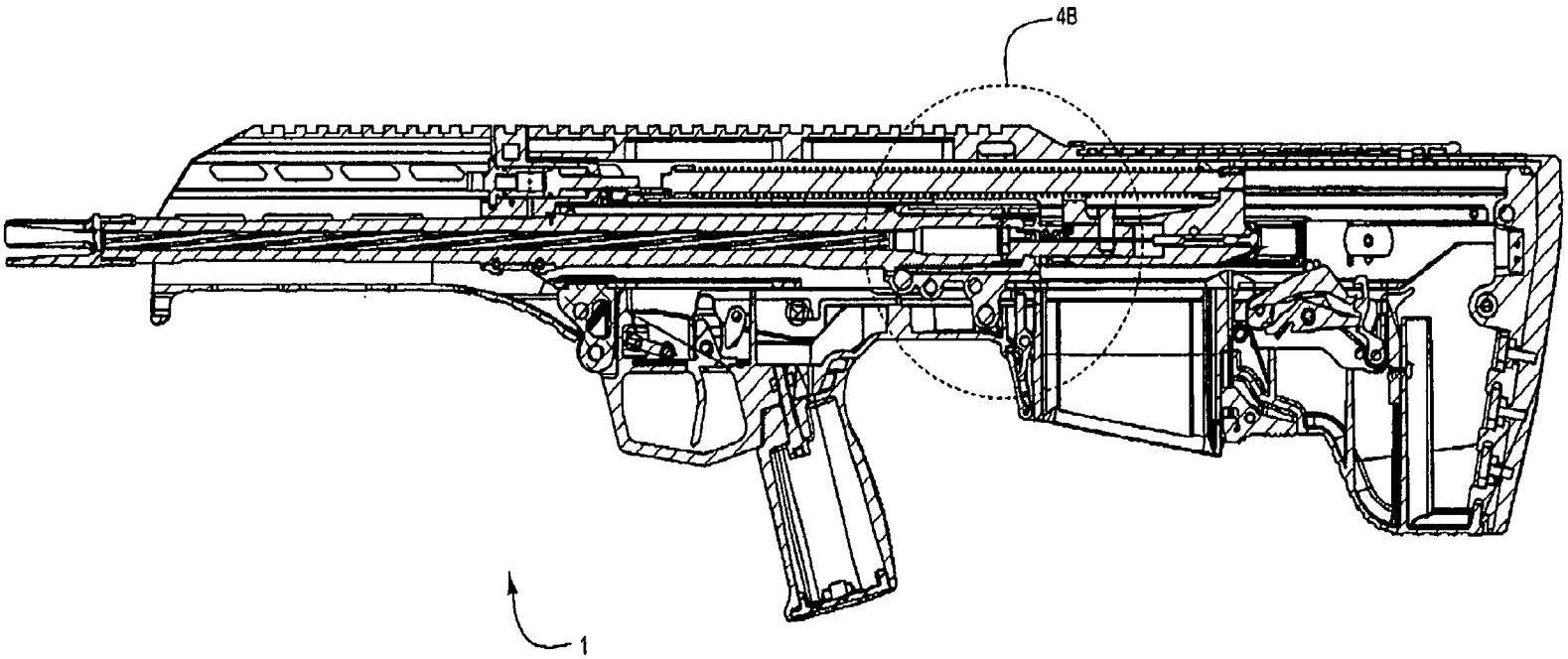
FIG. 4A is a sectional view of the firearm of FIG. 1A taken along Section 4A-4A.
Figure 4B:
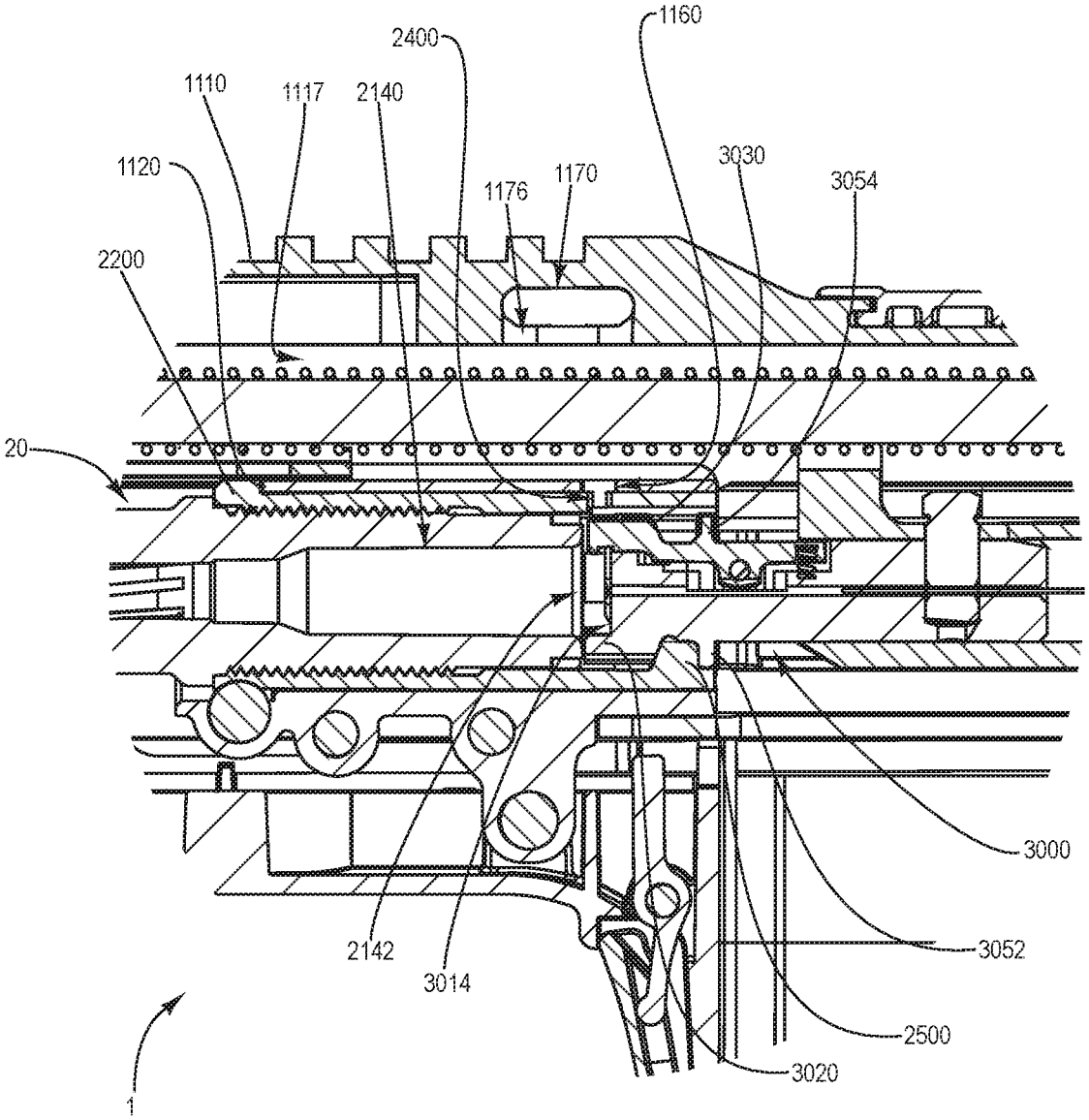
FIG. 4B is a magnified partial view of portion 4B of FIG. 4A.

In addition to capturing some of the energy generated by firing the cartridge 2500, the barrel assembly 20 is also configured to cooperate with the upper receiver assembly 1100 to direct over-pressurized gas transversely away from the central axis 2120 in the event of a barrel obstruction, and in particular in the event of a barrel obstruction relatively close to the chamber 2140 (FIG. 4B). Specifically, a barrel vent channel 2400 is defined in the barrel assembly 20. The barrel vent channel 2400 extends transversely away from the axis 2120 defined by the barrel 2100. In one example, the barrel vent channel 2400 extends radially away from the axis 2120 defined by the barrel 2100.

Figure 2B:
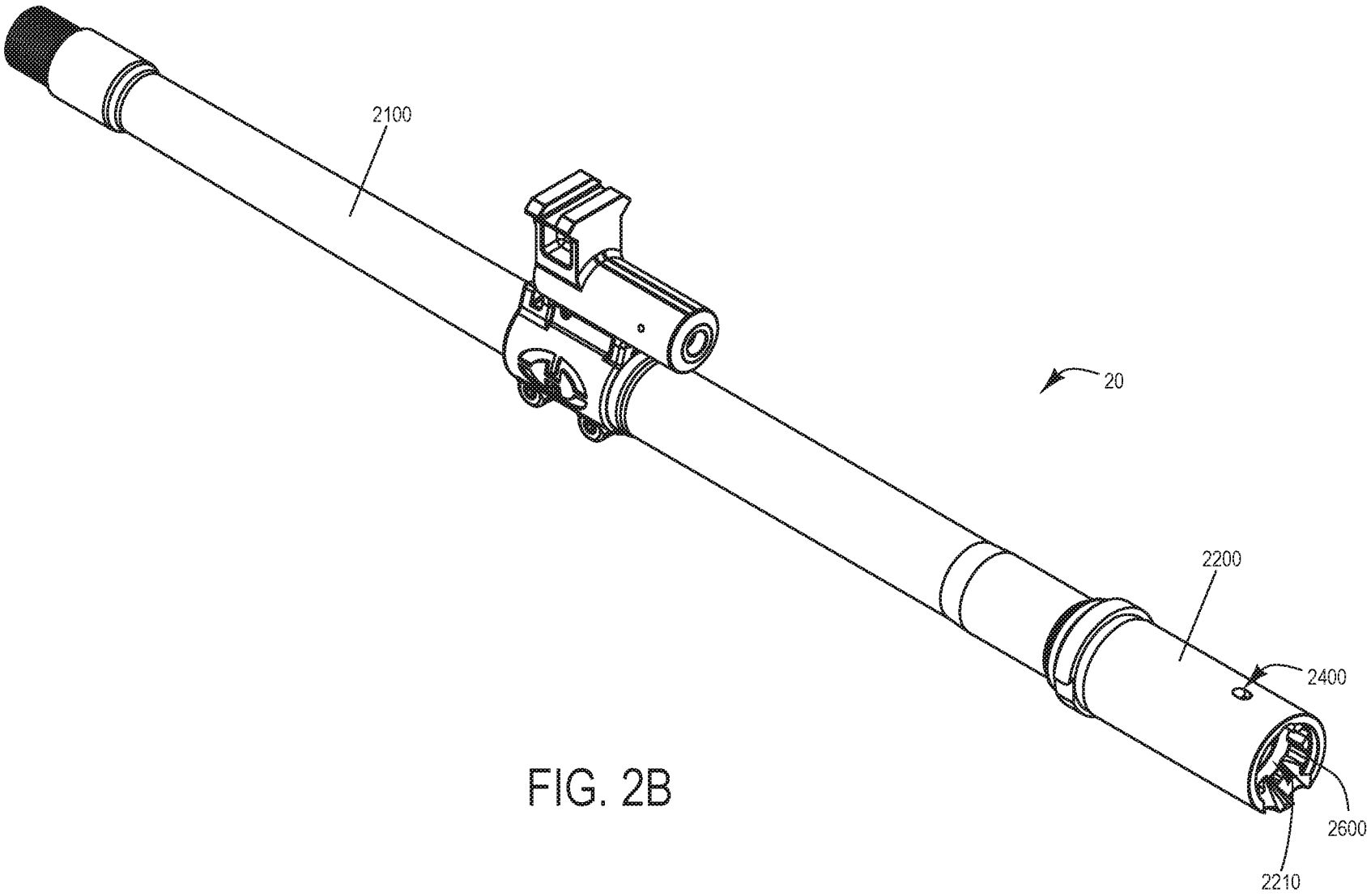
FIG. 2B is perspective view of a barrel assembly with the flash suppressor removed according to one example.

FIG. 2B is a rear perspective view of the barrel assembly 20. The barrel extension 2200 has a bolt receiving recess 2210 defined therein. The bolt receiving recess is in communication with the chamber 2140 (FIG. 4B). The barrel vent channel 2400 is in communication with the bolt receiving recess 2210. As illustrated in FIG. 2B, the barrel assembly 20 also includes barrel lugs 2600. In the illustrated example, the barrel lugs 2600 are associated with the barrel extension 2200 and are adjacent the barrel vent opening 2400, though it will be appreciated with the barrel lugs 2600 may be integrally formed with the barrel 2100 in some example or in some examples the barrel lugs 2600 may be omitted.

In examples in which the barrel assembly 20 includes barrel lugs 2600, at least a portion of the barrel vent channel 2400 is positioned forward or distally from the most forward portion of the barrel lugs 2600. In still further examples, the entire barrel vent channel 2400 may be positioned forward or distally of the most forward position of the barrel lugs 2600. As will be discussed at an appropriate point hereinafter, such a configuration helps guide over-pressurized gasses in desired directions in the event of obstruction of the barrel 2100.

FIG. 3 is an exploded view of the action 30. As shown in FIG. 3 the action 30 generally includes a bolt assembly 3000, a bolt carrier assembly 3100, a recoil assembly 3200 and a firing pin 3300. The bolt assembly 3000 is configured to engage the cartridge 2500 while the bolt carrier assembly 3100 moves the bolt assembly 3000 into a position for firing. The firing pin 3300 is coupled to the bolt assembly 3200 and interacts with the trigger assembly 1220 (FIG. 2A) in such a manner as to allow trigger assembly 1220 (FIG. 2A) to engage the firing pin 3300 to fire the cartridge 2500. Though described separated, it will be appreciated that the trigger assembly 1220 (FIG. 2A) may also be considered as part of the action 30.

The recoil assembly 3200 transfers some of the energy generated by firing the cartridge 2500 and acts on the bolt carrier assembly 3100 to cause the bolt assembly 3000 to extract the then-spent case 2510. In the present example, the piston 2310 (FIG. 2A) engages the recoil assembly 3200. Thereafter, the recoil assembly 3200 acts on the bolt carrier assembly 3100 (and thus the bolt assembly 3000 as well) to move back into a firing position while feeding another cartridge into the barrel assembly 20 (FIG. 2A) if another cartridge is in in place in a magazine (not shown). Accordingly, translation, particularly axial translation, of the bolt carrier assembly 3100 acts to move the bolt assembly 3000 to feed and extract the cartridge 2500. As will also be discussed in more detail herein after, the bolt assembly 3000 includes features which help contain and direct over-pressurized gas in a desired during over-pressure firing. The configuration of each of the components introduced above will be discussed in more detail followed by a more detailed discussion of an over-pressure event.

As introduced, the bolt assembly 3000 is configured to engage the cartridge 2500. In particular, the bolt assembly 3000 may generally include a bolt 3010 having a distal end 3012 and a proximal end 3014. In the illustrated example, a bolt face 3016 is formed in a distal end 3012 of the bolt 3010. The bolt face 3016 is configured to support the rim 2514 of the case 2510. Extraction support lugs 3020 and an extractor claw 3030 are shown coupled to or formed on opposing sides of the bolt 3010 to support and engage opposing sides of the casing 2510, as is well known in the art. In the illustrated example, the extraction support lugs 3020 extend distally beyond the bolt face 3016.

The bolt assembly 3000 further includes case support lugs 3022, 3024. The case support lugs 3022, 3024 may extend less distally than the case support lugs 3022, 3024. In some examples, the distal reach of the case support lugs 3022, 3024 may be generally coplanar with the bolt face 3016. In other examples, the distal reach of the case support lugs 3022, 3024 may be proximally of the bolt face 3016.

In each of these examples, the extraction support lugs 3020 and the case support lugs 3022, 3024 are configured to engage corresponding barrel lugs (2500, FIG. 2B) to allow the distal end 3012 of the bolt 3010 to allow the bolt assembly 3000 to be selectively locked and unlocked from the barrel assembly 20 (FIG. 2B). In particular, the extraction support lugs 3020, the case support lugs 3022, 3024, and the extractor claw 3030 are shaped and positioned to allow them to be may be moved forward or distally of the barrel lugs (2500, FIG. 2B) and into proximity with the chamber 2140 (best seen in FIG. 4B).

As the bolt assembly 3000 moves forward, the extractor claw 3030 and the extraction support lugs 3020 cooperate to allow the bolt assembly 3000 to engage the rim 2514 while urging the rest of the cartridge 2500 into chamber 2140 (FIG. 4B). While the cartridge 2500 is in the chamber 2140 (FIG. 4B) the case support lugs 3022, 3024 are in close proximity or even contact with the rim 2514 to support the rim 2514 during firing.

The rotation of the bolt assembly 3000 in this position moves the extraction support lugs 3020 and the case support lugs 3022, 3024 into and out of overlapping contact with the barrel lugs 2600, FIG. 2B) to thereby lock and unlock the bolt assembly 3000 from the barrel assembly 20 (also seen in FIG. 2B).

Rotation of the bolt assembly 3000 is achieved by engagement between the bolt assembly 3000 and the bolt carrier assembly 3100. In particular, the bolt assembly 3000 may include a bolt guide pin 3040 coupled to the bolt 3010. The bolt guide pin 3040 is configured to engage the bolt carrier assembly 3100. More specifically, the bolt carrier assembly 3100 includes a bolt carrier body 3110 having a distal end 3112 and a proximal end 3114. The bolt carrier body 3110 includes a bolt receiving recess 3115 defined therein to receive the proximal end 3014 of the bolt 3010. The bolt carrier body 3110 further includes a bolt guide engaging recess 3116 defined in the bolt carrier body 3110 and in communication with the bolt receiving recess 3115. Such a configuration allows the bolt guide pin 3040 to extend from the bolt 3010 and into the bolt guide engaging recess 3116 when the bolt 3010 is coupled to the bolt carrier body 3110.

In the illustrated example, the bolt guide engaging recess 3116 is configured to cause rotation of the bolt 3010 as the bolt carrier body 3110 moves axially. More specifically, when the bolt 3010 moves forward into contact with the barrel assembly 20 (FIG. 2A), and with the barrel extension 2200 (FIG. 2A) in particular, the bolt 3010 is stopped from axial translation while the bolt carrier body 3110 continues axial translation.

The relative axial translation of the bolt carrier body 3110 toward the bolt 3010 causes engagement between the bolt guide pin 3040 and the bolt carrier body 3110 via the bolt guide engaging recess 3116 to rotate the bolt 3010, which rotation may cause the bolt assembly 3000 to move into locking engagement with the barrel assembly 20. Similarly, movement of the bolt carrier body 3110 away from the bolt 3010 causes rotation of the bolt 3010 to unlock to the bolt 3010.

In the illustrated example, the recoil assembly 3200 is configured to facilitate the axial translation of the bolt carrier assembly 3100 described above. The recoil assembly 3200 generally includes an operation rod 3210, an op rod guide 3220, a recoil spring 3230, and a receiver coupler 3240. The operation rod 3210 in turn has a distal end 3212 and a proximal end 3214, the recoil spring 3230 includes a distal end 3232 and a proximal end 3234, and the receiver coupler 3240 has a distal end 3242 and a proximal end 3244. The proximal end 3214 of the operation rod 3214 extends through the recoil spring 3230, The op rod guide 3220 is coupled to the distal end 3212 of the operation rod 3210. A proximal end 3214 of the operation rod 3210 extends through the recoil spring 3230, through an opening 3246 in the distal end 3242 of the receiver coupler 3240, and into engagement with a operation rod engagement portion 3120 of the bolt carrier assembly 3100. The operation rod engagement portion 3120 may be coupled to or formed with the proximal portion 3114 of the bolt carrier body 3110. When thus assembled, the operation rod engagement portion 3120 is proximal of the distal end 3242 of the receiver coupler 3240. Further, when thus assembled, the recoil spring 3230 is between the receiver coupler 3240 and the op rod guide 3220 while also being over the operation rod 3210 such that the distal end 3232 abuts the op rod guide 3220 and the proximal end 3234 abuts the distal end 3242 of the receiver coupler 3240.

The receiver coupler 3240 may be secured in place within the upper receiver assembly 1100 (FIG. 2A) and thus may be held relatively stationary relative to other parts of the recoil assembly 3200. Such a configuration causes rearward movement of the distal end 3212 of the operation rod 3210 to compress the recoil spring 3230 between the op rod guide 3220 and the receiver coupler 3240 while also moving the bolt carrier assembly 3100 and bolt assembly 3000 rearwardly as well. The op rod guide 3220 may be manually moved rearward through use of the charging assembly 1190 (best seen in FIG. 1B) or through interaction with the gas block 2300 and piston 2310 (both best seen in FIG. 2A), as is well known in the art.

Referring still to FIG. 3, the compression of the recoil spring 3230 results in potential energy being stored in the compressed recoil spring 3230. Once rearward movement of the op rod guide 3220 and thus the bolt carrier assembly 3100 (and bolt assembly 3000) is complete, the recoil spring 3230 may return toward its uncompressed position thereby exerting a force against the op rod guide 3220, which in turn urges the bolt carrier assembly 3100, and all those components that translate therewith, forward.

Rear receiver engaging tabs 3130, 3132 may be coupled to or extend from the operation rod engagement portion 3120. Similar front receiver engaging tabs 3140, 3142 may be coupled to or extend from a distal portion 3112 of the bolt carrier body 3110. The rear receiver engaging tabs 3130, 3132 and the front receiver engaging tabs 3140, 3142 may engage corresponding features in the upper receiver assembly 1100, such as the rails 1180, 1182 (FIG. 1B) to guide axial translation of the bolt carrier assembly 3100 within and relative to the upper receiver assembly 1100.

As previously introduced, relative movement of the bolt carrier assembly 3100 and the bolt assembly 3000 cycles the action 30 to feed, fire, and extract the cartridge 2500 during normal cycling. The bolt assembly 3000 also includes features associated therewith for containing gasses during a barrel obstruction. In particular, the bolt assembly 3000 includes a sealing ring 3050. The sealing ring 3050 is found proximally or rearward of the bolt face 3016. The sealing ring 3050 may further be proximal or rearward of at least some of the lugs associated with the bolt assembly 3000, such as the extraction support lugs 3020, the case support lugs 3022, 3024 and a lug portion 3032 of the extractor claw 3030. In some examples, the sealing ring 3050 is entirely rearward of the extraction support lugs 3020, the case support lugs 3022, 3024 and the lug portion 3032 of the extractor claw 3030.

In the illustrated example, the sealing ring 3050 has a generally annular shape. In at least one example, the sealing ring 3050 includes a bolt body portion 3052 and an extractor portion 3054. Such a configuration allows the sealing ring 3050 to form the generally annular shape when the action 30 is assembled, as best seen in FIG. 2A. Referring still briefly to FIG. 3, the sealing ring 3050 helps contain over-pressurized gasses that may escape from behind the bolt assembly 3000 if the cartridge 2500 during over-pressure firing conditions.

FIG. 4A is a cross-sectional view of the rifle taken along Section 4A-4A of FIG. 1A. FIG. 4B is an enlarged view of portion 4B of FIG. 4A. FIG. 4B illustrates the barrel vent channel 2400 in communication with the barrel block vent opening 1160. As previously introduced, the barrel block vent opening 1160 in turn is in communication with the central opening 1117 of the upper receiver body 1110, which turn is in also in communication with the receiver vent channel 1170 via vent portion 1176.

Referring briefly to FIG. 1B, the receiver vent channel 1170 in turn may have the receiver vent plugs 1172, 1174 coupled thereto with an interference fit. In at least one example, the receiver vent plugs 1172, 1174 are made of a lower durometer material than the upper receiver body 1110. For example, the upper receiver body 1110 may be made of a metallic material or a high durometer thermoplastic while the receiver vent plugs 1172, 1174 may be made of a lower durometer thermoplastic material, other plastic materials, and/or a rubber material. Such a configuration allows the receiver vent plugs 1172, 1174 to plug the upper receiver body 1110 and prevent debris or other contaminants from entering the upper receiver body 1110 and thus other components internal to the upper receiver body 1110 during normal operation but to blow out when pressurized gas is introduced in the central opening 1117 of the upper receiver body 1110 via the barrel block 1120 due to overpressure during over-pressure firing conditions.

Referring again to FIG. 4B, the barrel vent channel 2400 is positioned proximally or just behind the chamber 2140. In particular, in at least one example, at least a portion of the barrel vent channel 2400 is defined in the barrel assembly 20 (FIG. 2A) and the barrel extension 2200 in particular at a position between a proximal end 2142 of the chamber 2140 and the barrel lugs 2600. In at least one example, the entire barrel vent channel 2400 is defined in the barrel assembly 20 and the barrel extension 2200 specifically, at a position between a proximal end 2142 of the chamber 2140 and the barrel lugs 2600.

In at least one example, at least a portion of the barrel block vent opening 1160 is defined in the barrel block 1120 corresponding to a location on the barrel assembly 20 between a proximal end 2142 of the chamber 2140 and the barrel lugs 2600 when the barrel assembly 20 is coupled to the barrel block 1120. In at least one example, the entire barrel block vent opening 1160 is defined in the barrel block 1120 corresponding to a location on the barrel assembly 20 between a proximal end 2142 of the chamber 2140 and the barrel lugs 2600 when the barrel assembly 20 is coupled to the barrel block 1120.

In at least one example, at least a portion of the barrel vent channel 2400 is forward of the bolt face 3016 when the bolt assembly 3000 is in battery. When bolt assembly 3000 is in battery, the associated components of the bolt assembly 3000 are at the intended position to fire a cartridge in the chamber. In at least one example, the entire barrel vent channel 2400 is forward of the bolt face 3016 when the bolt assembly 3000 is in battery.

In at least one example, at least a portion of the receiver vent opening 1160 is forward of the bolt face 3016 when the bolt assembly 3000 is in battery. In at least one example, all of the receiver vent opening 1160 is completely forward of the bolt face 3016 when the bolt assembly 3000 is in battery.

Referring now simultaneously to FIG. 3 and FIG. 4B, when the cartridge 2500 is fired, the case 2510 expands to conform to the shape of the chamber 2140. If the barrel 2100 is unobstructed, the case 2510 may be sufficiently strong to ensure that projectile 2520 is driven distally out of the barrel 2100. However, if the barrel 2100 is obstructed, the gasses are not able to escape via their normal routes and thus are directed through the path of least resistance. If the obstruction is relatively near the chamber 2140, the pressure from the obstruction will be relatively higher than if the obstruction were further away from the chamber 2140 as the gasses will have less volume into which they can expand, but may occur due to other factors, such as improper loading.

If the pressure exceeds that which the case 2510 is able to withstand, the case 2510 will rupture. Pressure conditions which cause the case 2510 to rupture may be referred to as overpressure firing conditions. Overpressure firing conditions typically occur when a cartridge is fired while the barrel 2100 is obstructed and particularly while the barrel 2100 is obstructed near the chamber 2140. As the case 2510 ruptures during overpressure firing conditions gas flow from the case 2510. The case support lugs 3022, 3024 support the rim 2514, thereby reducing rearward failure and/or movement of the rim 2514. The gasses are then incident on the rest of the case support lugs, 3022, 3024, the extraction support lugs 3020, and the lug portion 3032 of the extractor claw 3030.

Still referring to FIG. 3 and FIG. 4B, as previously discussed, the bolt assembly 3000 includes a sealing ring 3050. The sealing ring 3050, including the bolt body portion 3052 and the extractor portion 3054, are in place within the barrel assembly 20 and the barrel extension 2200 in particular when the bolt assembly 3000 is in battery and reduce the size of any gap between the bolt 3010 and the barrel extension 2200. While thus positioned, the sealing ring 3050 limits the flow of gasses that may be directed thereto from the chamber 2140. Particularly, the flow of such rearwardly directed gas is at least partially contained or blocked by the sealing ring 3050. As shown in FIG. 4B, the bolt body portion 3052 and the extractor portion 3054 are in close proximity or even in contact with the barrel lugs 2600 as well as in close proximity or even contact with the inner surfaces of the barrel extension 2200. Such proximity and contact between the various surfaces limits the rearward flow of gasses through the barrel extension 2200 and the sealing ring (FIG. 3) and thus limits the flow of gas escaping the barrel assembly 20 via the bolt assembly 3000.

Referring again simultaneously to FIG. 3 and FIG. 4B, as gas escapes the then ruptured case 2500 during overpressure firing, gas is also incident on the barrel extension 2200. The configuration of the barrel vent channel 2400 and the barrel block vent opening 1160 causes at least a portion of the gas escaping the then-ruptured case 2500 to be directed transversely away from the barrel assembly 20. In at least one example, directing the gasses through the barrel vent channel 2400 and the barrel block vent opening 1160 vents the gasses into the central opening 1117 of the upper receiver body 1110. The amount of gasses that escape into other parts of the firearm 1 may be reduced in those examples where the bolt assembly 3000 includes the sealing ring 3050.

In those examples that include a sealing ring 3050 and those that do not, gases directed into the central opening 1117 are also incident on the receiver vent channel 1170 via vent portion 1176 thereby causing the vent plugs 1172, 1174 (FIG. 1B) to may be blown out of engagement with the upper receiver body 1110 to provide additional venting pathways for the gasses during the overpressure firing.

Accordingly, the rifle 1 contains and directs gasses generated during overpressure firing to cause the gasses to flow transversely to the axial direction of the barrel 2100 to guide the gasses along predetermined, alternate flow paths to help reduce the flow of gasses toward an operator to reduce injury to an operator while reducing damage or destruction to other parts of the rifle, which may further reduce the likelihood of injury to the operator.

What is claimed is:

1. A firearm, comprising:

a barrel assembly, comprising a barrel having a proximal end and a distal end comprising a muzzle of the barrel, the barrel having:

a chamber defined in the proximal end of the barrel, the chamber having a distal end and a proximal end, and a bore extending distally from the distal end of the chamber, the bore defining a central axis of the barrel assembly, and a barrel extension coupled to the proximal end of the barrel, the barrel extension having a distal end and a proximal end, the barrel extension defining a bolt receiving recess in communication with the chamber, the barrel extension further having a barrel vent channel therein in communication with the bolt receiving recess, the barrel vent channel being defined in the barrel extension in a direction that is transverse to the central axis of the barrel assembly, the barrel assembly being configured to allow gasses associated with overpressure firing conditions to be directed through the barrel vent channel, the barrel extension further having barrel lugs in the proximal ends thereof, wherein the barrel vent channel is defined in the barrel extension at a position that is distal of the barrel lugs; and a bolt assembly, the bolt assembly having:

a bolt having a distal end and a proximal end, the distal end having a bolt face formed thereon, and a sealing ring between the bolt face and the proximal end of the bolt.

2. The firearm of claim 1, wherein the distal end of the bolt is configured to be at least partially received within the barrel extension to move the bolt assembly into battery and wherein the sealing ring at least partially obstructs a gap between the bolt and the barrel extension when the bolt assembly is in battery.

3. The firearm of claim 2, wherein the bolt further includes a plurality of bolt lugs and the barrel extension includes a plurality of barrel lugs, the bolt lugs being configured to be received within the barrel extension distally of the barrel lugs when the bolt assembly is in battery.

4. The firearm of claim 3, wherein the sealing ring abuts the barrel lugs when the bolt assembly is in battery.

5. The firearm of claim 3, wherein the barrel lugs includes extraction support lugs and case support lugs, the extraction support lugs extending distally more than the case support lugs.

6. The firearm of claim 1, wherein the firearm is configured as an auto-loading rifle.

7. The firearm of claim 1, wherein the barrel vent channel is defined in the barrel extension at a position that is at least partially between the proximal end of the chamber and the bolt face when the bolt assembly is in battery.

8. The firearm of claim 1, wherein the barrel vent channel is defined in the barrel extension at a position that is entirely between the proximal end of the chamber and the bolt face when the bolt assembly is in battery.

* * * * *